US006938610B2

(12) United States Patent
Braun et al.

(10) Patent No.: US 6,938,610 B2
(45) Date of Patent: Sep. 6, 2005

(54) FUEL INJECTION DEVICE WITH A PRESSURE BOOSTER

(75) Inventors: Wolfgang Braun, Ditzingen (DE); Bernd Mahr, Plochingen (DE); Martin Kropp, Tamm (DE); Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 26 days.

(21) Appl. No.: 10/343,215

(22) PCT Filed: May 17, 2002

(86) PCT No.: PCT/DE02/01792

§ 371 (c)(1),
(2), (4) Date: Jul. 25, 2003

(87) PCT Pub. No.: WO02/099270

PCT Pub. Date: Dec. 12, 2002

(65) Prior Publication Data

US 2004/0089269 A1 May 13, 2004

(30) Foreign Application Priority Data

Jun. 1, 2001 (DE) ..... 101 26 686

(51) Int. Cl.[7] ..... F02M 37/04
(52) U.S. Cl. ..... 123/446; 123/496
(58) Field of Search ..... 123/446, 500, 123/501, 467, 496

(56) References Cited

U.S. PATENT DOCUMENTS

| | | | | | |
|---|---|---|---|---|---|
| 3,893,629 | A | * | 7/1975 | Okamoto | 239/88 |
| 4,271,807 | A | | 6/1981 | Links et al. | |
| 4,878,471 | A | * | 11/1989 | Fuchs | 123/446 |
| 5,056,488 | A | | 10/1991 | Eckert | |
| 5,127,381 | A | * | 7/1992 | Kupzik et al. | 123/467 |
| 5,492,098 | A | * | 2/1996 | Hafner et al. | 123/446 |
| 5,517,972 | A | * | 5/1996 | Stockner | 123/496 |
| 5,730,104 | A | * | 3/1998 | Hafner | 123/446 |
| 5,868,317 | A | | 2/1999 | English | |
| 5,954,029 | A | * | 9/1999 | Peters et al. | 123/446 |
| 6,293,252 | B1 | * | 9/2001 | Niethammer et al. | 123/447 |
| 6,446,603 | B1 | * | 9/2002 | Bonse et al. | 123/446 |
| 6,453,875 | B1 | | 9/2002 | Mahr et al. | |
| 6,604,507 | B1 | * | 8/2003 | Lei et al. | 123/446 |

FOREIGN PATENT DOCUMENTS

| | | | |
|---|---|---|---|
| DE | 28 03 049 | | 8/1979 |
| DE | 40 04 610 | A1 | 10/1990 |
| DE | 19 910 970 | A1 | 9/2000 |
| GB | 2 150 643 | A | 7/1985 |
| JP | 1-182221 | | 7/1989 |
| JP | 10 159680 | A | 6/1998 |
| WO | 01/23753 | * | 4/2001 |

* cited by examiner

*Primary Examiner*—Carl S. Miller
(74) *Attorney, Agent, or Firm*—Ronald E. Greigg

(57) ABSTRACT

A fuel injection system includes a pressure chamber having a displacable piston which can be subjected to pressure via a low-pressure-side pressure booster chamber for compressing the fuel in a high-pressure-side pressure booster chamber to be delivered to an injector. The stroke of the piston is controllable essentially by the pressure in a differential chamber of the pressure chamber and is used to vary the fuel pressure delivered to the injector. Provision is made for enlarging the cross section of the outlet cross section out of the differential chamber of the pressure chamber are provided. The fuel pressure during the injection can be varied. A pressure increase can be simply achieved.

5 Claims, 2 Drawing Sheets

FUEL INJECTION DEVICE WITH A PRESSURE BOOSTER

CROSS-REFERENCE TO RELATED APPLICATIONS

This application is a 35 USC 371 application of PCT/DE 02/01792 filed on May 17, 2002.

BACKGROUND OF THE INVENTION

1. Field of the Invention

The invention relates to an improved fuel injection system employing a pressure booster for use in an internal combustion engine.

2. Description of the Prior Art

For better comprehension of the specification and claims, several terms will now be defined: The fuel injection system of the invention can be embodied as either stroke-controlled or pressure-controlled. Within the context of the invention, the term stroke-controlled fuel injection system is understood to mean that the opening and closing of the injection opening is effected with the aid of a displaceable nozzle needle, on the basis of the hydraulic cooperation of the fuel pressure in a nozzle chamber and in a control chamber. A pressure reduction inside the control chamber causes a stroke of the nozzle needle. Alternatively, the deflection of the nozzle needle can be effected by a final control element (actuator). In a pressure-controlled fuel injection system of the invention, the nozzle needle is moved counter to the action of a closing force (spring) by the fuel pressure prevailing in the nozzle chamber of an injector, so that the injection opening is uncovered for an injection of the fuel from the nozzle chamber into the cylinder. The pressure at which fuel emerges from the nozzle chamber into a cylinder of an internal combustion engine is called injection pressure, while the term system pressure means the pressure at which fuel is available or kept on hand inside the fuel injection system. The term fuel metering means furnishing a defined fuel quantity for injection. The term leak fuel, or leakage is understood to mean a quantity of fuel that occurs in operation of the fuel injection system (such as a guide leakage) and that is not used for injection and is pumped back to the fuel tank. The pressure level of this leak fuel can have a standing pressure, and after that the fuel is depressurized to the pressure level of the fuel tank.

Many engine manufacturers want to have a shallow pressure increase edge at the onset of the injection. Often, a boot phase is also wanted, for reducing emissions. In fuel injection systems with pressure chambers of the kind known for instance from German Patent Disclosure DE-A1 199 10 970, the pressure chamber can be used for shaping the course of injection. Thus the desired course of injection can be realized without additional parts such as deflection pistons. To vary the pressure course, the motion of the piston of the pressure chamber can be utilized. Varying the inlet cross section to the high-pressure-side pressure booster chamber as a function of stroke is known from U.S. Pat. No. 5,568,317. hereby incorporated by reference. This US patent proposes a multi-stage control of the inlet cross section.

SUMMARY OF THE INVENTION

The present invention enables varying the fuel pressure during the injection and attaining a pressure increase with simple means. If for example two outlet cross sections (a larger one and a smaller one) out of the differential chamber of the pressure chamber are uncovered in succession as a function of the piston stroke of the pressure chamber, then a so-called boot injection can be performed.

BRIEF DESCRIPTION OF THE DRAWINGS

Three exemplary embodiments of the fuel injection system of the invention are explained herein below, with reference to the drawings, in which.

DESCRIPTION OF THE PREFERRED EMBODIMENTS

Figure 1:
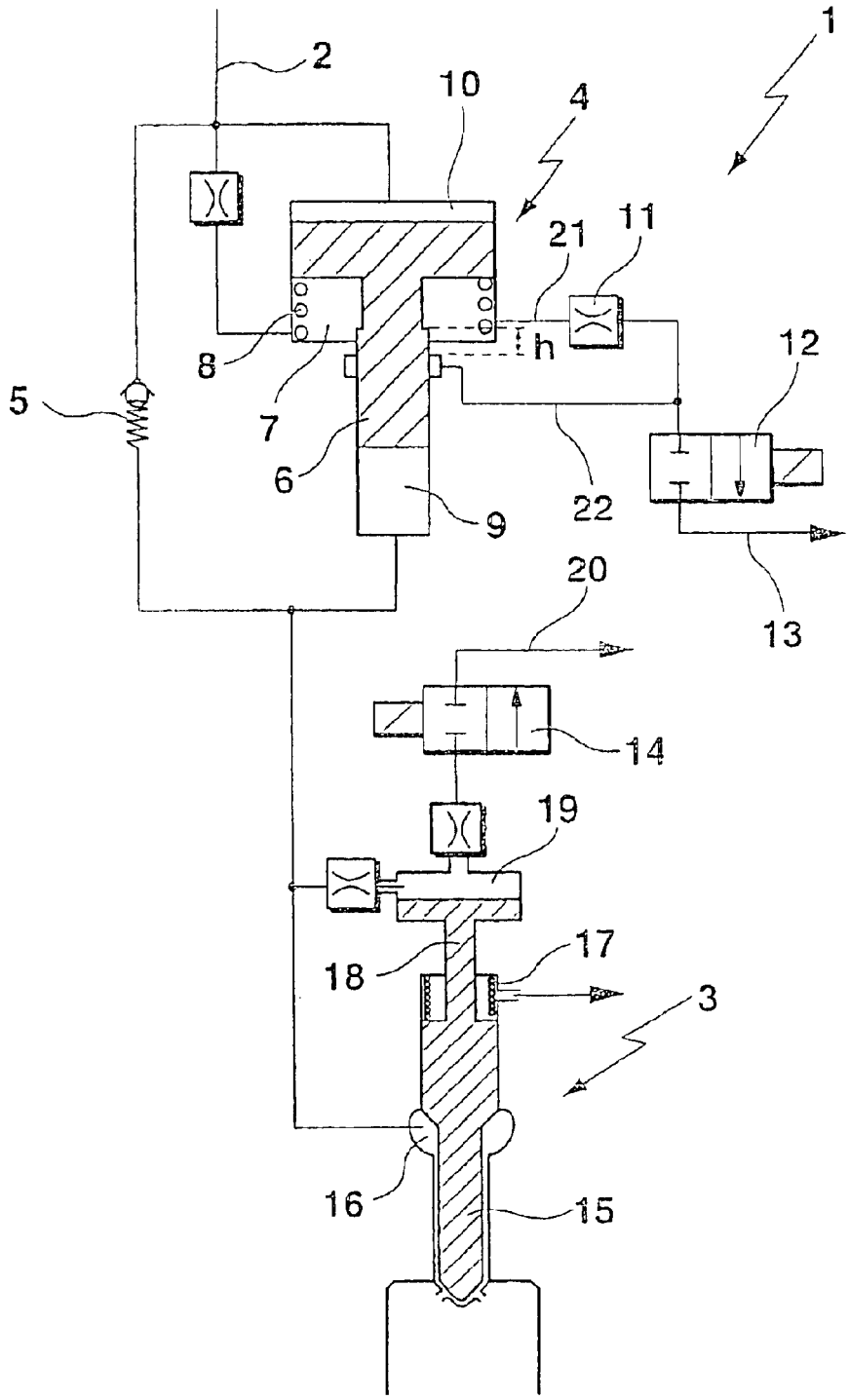
FIG. 1 is a stroke-controlled fuel injection system according to the invention with a pressure chamber with a two-stage outlet cross section.

In the first exemplary embodiment, shown in FIG. 1, of a stroke-controlled fuel injection system 1, a quantity-regulated fuel pump pumps fuel from a supply tank via a supply line into a central pressure reservoir (common rail), from which a plurality of pressure lines 2, corresponding in number to the number of individual cylinders, lead away to the individual injectors 3 (injection devices) protruding into the combustion chamber of the internal combustion engine to be supplied. In FIG. 1, only one of the injectors 3 is shown. With the aid of the fuel pump, a first system pressure is generated and stored in the common rail. This first system pressure is used for preinjection and is needed both for postinjection (HC enrichment for the sake of exhaust gas posttreatment or soot reduction) and to define an injection course with a plateau (boot injection). For injecting fuel at a second, higher system pressure, each injector 3 is assigned a respective local pressure booster 4 having a check valve 5 and a displaceable piston 6. Such fuel injection systems are known for instance from DE-A1 199 10 970.

For controlling the pressure booster 4, the pressure in the differential chamber 7, which is formed by a transition from a larger to a smaller piston cross section, is used. For refilling and deactivating the pressure chamber 9, the differential chamber 7 is subjected to a supply pressure (rail pressure). Then, the same pressure conditions (rail pressure) prevail at all pressure faces of a piston 6. The piston 6 is pressure-equalized. By means of an additional spring 8, the piston 6 is pressed into its outset position. For activating the pressure booster 4, the differential chamber 7 is pressure-relieved, and the pressure booster 4 generates a pressure boost in accordance with the ratio of surface areas. With this type of control, it can be attained that a low-pressure-side pressure booster chamber 10 need not be pressure-relieved in order to restore the pressure booster 4 and refill a high-pressure-side pressure chamber 9. The depressurization losses in a small hydraulic boost can thus be reduced sharply.

For controlling the pressure chamber, instead of a complicated 3/2-way valve, a throttle 11 and a simple 2/2-way valve 12 are used. A throttle connects the differential chamber 7 with fuel, which is at supply pressure from a common rail, and a throttle 11 connects the differential chamber 7 to the valve 12. The 2/2-way valve 12 thus connects the differential chamber 7 to a leak fuel line 13. The throttle 11 should be designed to be as small as possible, yet still large enough that the piston 6 returns to its outset position between injection cycles. A guide leakage of the piston 6 can be used as the throttle. When the 2/2-way valve 12 is closed, no leakage occurs in the guides of the piston 6, since the leakage from the differential chamber 7 is subjected to pressure. The throttle can also be integrated with the piston.

If the 2/2-way valves 12 and 14 are closed, the injector 3 is under the pressure of the common rail. The pressure booster 4 is in its outset position. An injection at rail pressure can now be effected by means of the valve 14. If an injection at higher pressure is desired, then the 2/2-way valve 12 is triggered (opened), and a pressure boost is thus attained.

The injection is effected via a fuel metering, with the aid of a nozzle needle 15 that is axially displaceable in a guide bore and has a conical valve sealing face on one end, with which it cooperates with a valve seat face on the housing of the injector 3. On the valve seat face of the injector housing, injection openings are provided. Inside a nozzle chamber 16, a pressure face pointing in the opening direction of the nozzle needle 15 is exposed to the pressure prevailing there, which is delivered to the nozzle chamber 16 via a pressure line. Coaxially to a valve spring 17, a thrust piece 18 also engages the nozzle needle 15 and with its face end remote from the valve sealing face it defines the control chamber 19. The control chamber 19 has an inlet with a first throttle from the fuel pressure connection and an outlet with a second throttle, which is controlled by the 2/2-way valve 14, to a pressure relief line 20.

Fuel at the first or second system pressure constantly fills the nozzle chamber 16 and the control chamber 19. Upon actuation (opening) of the 2/2-way valve 14, the pressure in the control chamber 19 can be reduced, so that as a consequence the pressure force in the nozzle chamber 16 acting on the nozzle needle 15 in the opening direction exceeds the pressure force acting on the nozzle needle 15 in the closing direction. The valve sealing face lifts from the valve seat face, and fuel is injected. The process of pressure relief of the control chamber 19 and thus the stroke control of the nozzle needle 15 can be varied by way of how the throttles are dimensioned.

The end of the injection is initiated by re-actuating (closing) the 2/2-way valve 14, which disconnects the control chamber 19 from the leak fuel line 20, so that a pressure builds up again in the control chamber 19 that can move the thrust piece 18 in the closing direction.

To modify the pressure increase from the pressure booster 4, the outlet cross section from the differential chamber 7 can be embodied to have multiple stages. In the outset position of the piston 6, only the outlet path 21 is opened. As a result, upon opening of the valve 12, a slow pressure drop inside the differential chamber 7 occurs, and this creates a damped motion of the piston 6, and thus a slow pressure increase in the pressure chamber 9 to a medium pressure level is effected. After a stroke h, a second, larger outlet path 22, which communicates with a circumferential groove in the wall of the differential chamber 7, becomes operative because the circumferential groove is uncovered. The result is a faster pressure drop inside the differential chamber 7 and a corresponding faster, undamped motion of the piston 6, with a resultant maximum pressure level increase in the pressure in chamber 9. After the closure of the valve 12, the piston 6 is moved back into its outset position. The pressure booster 4 is deactivated.

Figure 2:
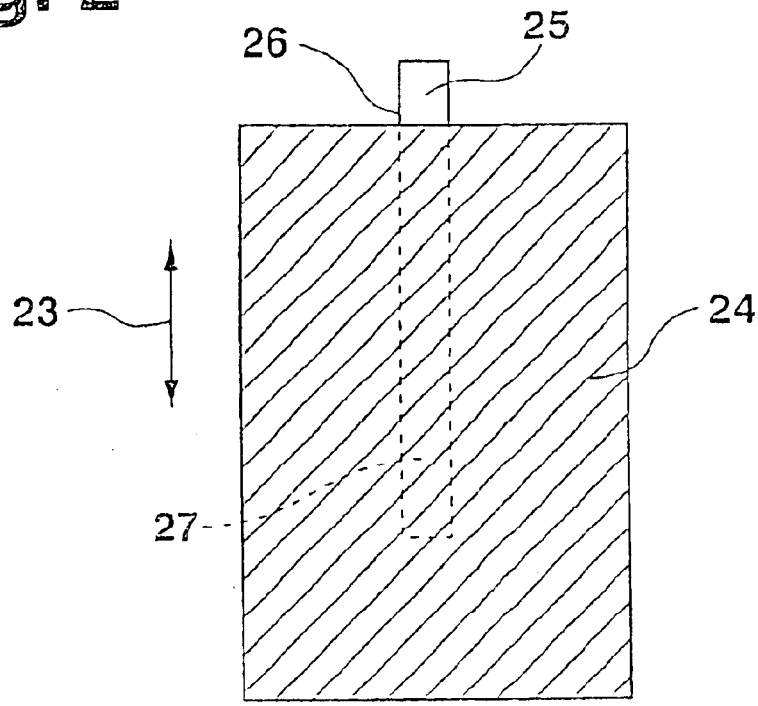
FIG. 2 shows a first means for continuously variable changing the outlet cross section.

FIG. 1 shows structure which generates a stepwise increase in the cross section of the outlet from differential chamber 7. Instead of the stepwise increase in the cross section of the outlet from the differential chamber 7, a continuous increase in cross section can also be embodied (FIGS. 2 and 3), essentially by orienting the groove vertically along the differential chamber 7, instead of its being circumferential as shown in FIG. 1. By this means, a continuously varying rate of pressure increase without interfering pressure fluctuations can be achieved. In FIG. 2, piston 24 corresponds to piston 6 in FIG. 1. By means of motion of the piston in its direction of motion 23, and depending on the position of the piston 24, only a part of face 25 of a slotlike opening 26, which is oriented vertically along differential chamber 7 of the pressure booster 4, is uncovered by a control edge of piston 24, while the remaining face 27 of the opening 26 is covered. The opening 26 in the wall face of the differential chamber 7 forms the communication of the differential chamber 7 (see FIG. 1) with the leak fuel line 22 (see FIG. 1) and is closable by the piston 24. As the piston stroke increases in length, a larger outlet cross section of slotlike opening 26 is uncovered.

Figure 3:
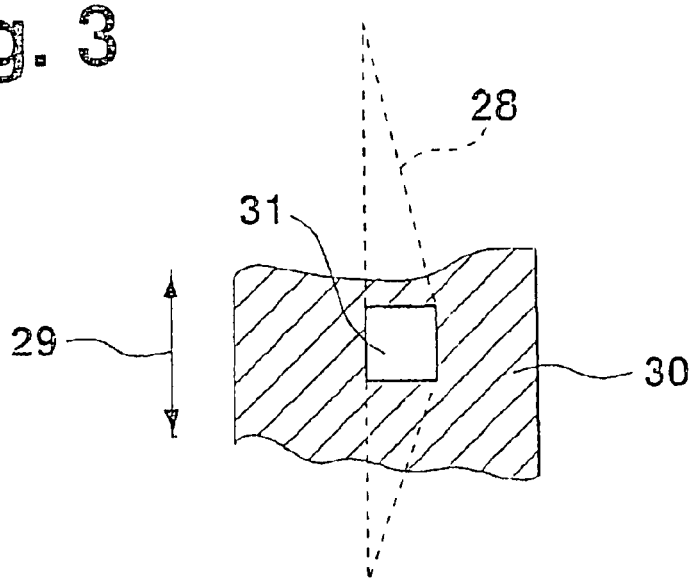
FIG. 3 shows a second means for continuously variable changing the outlet cross section.

In FIG. 3, piston 30 corresponds to piston 6 of FIG. 1. Here a slotlike, generally vertical opening 28 in the wall face of the differential chamber 7 of a pressure booster has a cross-sectional area that is variable in the direction of motion 29 of the piston 30. The piston 30 itself has a recess 31, which communicates with generally vertical slotlike opening 28 in the side of the differential chamber 7 (see FIG. 1), and slot 28 communicates with the leak fuel line 22, see FIG. 1. The recess 31 forms a kind of control window that slides along the slot 28. The outlet cross section can be varied arbitrarily by way of the course of the piston stroke. Alternatively, the slotlike opening 28 can also be embodied in the piston 30, and the control edge again cooperates with a recess 31 that can be embodied in the wall face of the differential chamber 7.

The foregoing relates to preferred exemplary embodiments of the invention, it being understood that other variants and embodiments thereof are possible within the spirit and scope of the invention, the latter being defined by the appended claims.

We claim:

1. In a fuel injection system (1), having a pressure booster (4) which has a displaceable piston which can be subjected to pressure from a low-pressure-side pressure booster chamber (10) for compressing the fuel in a high-pressure-side pressure booster chamber (9) to be delivered to an injector (3), in which the stroke of the piston is controllable essentially by the pressure in a differential chamber (7) of the pressure booster (4) and is used to vary the fuel pressure delivered to the injector (3), the improvement comprising means for controllably varying the area of an outlet from the differential chamber (7) of the pressure booster (4).

2. In a fuel injection system (1), having a pressure booster (4) which has a displaceable which can be subjected to pressure from a low-pressure-side pressure booster chamber (10) for compressing the fuel in a high-pressure-side pressure booster chamber (9) to be delivered to an injector (3), in which the stroke of the piston is controllable essentially by the pressure in a differential chamber (7) of the pressure booster (4) and is used to vary the fuel pressure delivered to the injector (3), the improvement comprising means for controllably varying the area of an outlet from the differential chamber (7) of the pressure booster (4), wherein the means for controllably varying the area of the outlet includes a first outlet portion which is not covered by the piston, and a second outlet portion which is covered by the piston during at least part of the stroke of the piston.

3. In a fuel injection system (1), having a pressure booster (4) which has a displaceable which can be subjected to pressure from a low-pressure-side pressure booster chamber (10) for compressing the fuel in a high-pressure-side pressure booster chamber (9) to be delivered to an injector (3), in which the stroke of the piston is controllable essentially by the pressure in a differential chamber (7) of the pressure booster (4) and is used to vary the fuel pressure delivered to the injector (3), the improvement comprising means for controllably varying the area of an outlet from the differential chamber (7) of the pressure booster (4), wherein the means for controllably varying the area of the outlet are embodied by at least one slotlike opening (26; 28) between the differential chamber (7) of the pressure chamber (4) and a leak fuel line (22), and by the piston covering or uncovering varying amounts of the opening (26; 28).

4. The fuel injection system of claim 3 wherein the piston has a control edge up to which the opening is uncovered.

5. The fuel injection system of claim 3 wherein in the piston (30) comprises a recess (31), which can be disposed above the opening (28) to define an uncovered region of the opening (28).

* * * * *